US005269624A

United States Patent [19]

Kramer

[11] Patent Number: 5,269,624

[45] Date of Patent: Dec. 14, 1993

[54] EXPANSION JOINT SYSTEM

[75] Inventor: Fred Kramer, Hales Corners, Wis.

[73] Assignee: Tremco, Inc., Beachwood, Ohio

[21] Appl. No.: 876,660

[22] Filed: Apr. 30, 1992

[51] Int. Cl.[5] ..... E01C 11/02

[52] U.S. Cl. ..... 404/64; 404/65

[58] Field of Search ..... 404/47, 64, 65; 52/396, 52/403

[56] References Cited

U.S. PATENT DOCUMENTS 4,367,976 1/1983 Bowman ..... 404/64 X 4,533,278 8/1985 Corsover et al. ..... 404/65

4,637,085 1/1987 Hartkorn ..... 404/64 X

*Primary Examiner*—William P. Neuder

*Attorney, Agent, or Firm*—Ralph E. Jocke; David P. Dureska

[57] ABSTRACT

An expansion joint system (10) traverses a slot (12) between concrete slabs (14, 16). The system includes nosings (32, 34) overlying an expansible member (40) of unitary construction and made from resilient material. The expansible member has ribbed flaps (42, 44) with holes (48) therethrough. The flaps are attached to the slabs by a layer (46) of adhesive bedding material. The expansible member includes a first segment (69), a second segment (82) and a third segment (96). The segments each include pad portions (70, 84, 98), and web portions (78, 92, 102) extending downward from the pad portions into the slot. The adjacent web portions are joined at locations (106, 112) vertically below the pad portions of the segments.

17 Claims, 4 Drawing Sheets

EXPANSION JOINT SYSTEM

This invention relates to expansion joints that extend between slabs of relatively rigid material. Specifically this invention relates to an expansion joint system that has improved expansion and contraction capabilities, and is resistant to failure.

BACKGROUND ART

A number of expansion joint systems are known in the prior art. These systems are used between two slabs of relatively rigid material such as concrete. The slot enables the slabs to move relative to one another. Relative movement may occur both in the vertical and horizontal directions due to factors such as thermal expansion, settling or relative loading. Expansion joint systems are commonly used in bridges, walkways, parking structures, roadways and in other structures that are used to carry vehicle or pedestrian traffic.

Expansion joints typically serve to maintain a continuous surface above the slot between the slabs. Expansion joint systems also typically aid in preventing water and other contaminants from getting into the slot where they may damage the joint or the adjacent slabs. Problems may occur with various types of prior art expansion joint systems when the slabs move further apart than the expansion capability of the system. This causes the joint to fail due to rupture or separation from the slabs. In other circumstances the slabs may move together, compressing the joint to the point that it is destroyed or disengages from the slabs. Most expansion joints also undergo repeated cycles of expansion and contraction. This repeated cycling of the joint system may cause the joint to fail due to fatigue. Also, expansion joint system components are subjected to dirt and other contaminants which may attack the materials and cause premature failures.

Expansion joint systems known in the prior art are prone to failure in cold weather. Impacts from traffic or snow plows moving over the joint may cause the joint to tear or separate from the adjacent slabs.

The failure of expansion joint systems is particularly problematic in areas where the system experiences shear or where there is large differential deflection between adjacent slabs due to loading or thermal expansion. Particularly difficult applications for expansion joint systems include the joints between the concrete slabs that comprise parking structures, plaza decks and pedestrian bridges.

Thus, there exists a need for an expansion joint system that is more reliable, has greater expansion and contraction capability and is more shock and fatigue resistant than prior art expansion joint systems.

DISCLOSURE OF INVENTION

It is an object of the present invention to provide an expansion joint system that enables greater separation between adjacent slabs without failure.

It is a further object of the present invention to provide an expansion joint system that enables greater reduction of a distance between adjacent slabs without failure.

It is a further object of the present invention to provide an expansion joint system that provides greater protection against permeation of the joint by water or other contaminants.

It is a further object of the present invention to provide an expansion joint system that is resistant to fatigue failure due to repeated expansion and contraction cycles.

It is a further object of the present invention to provide an expansion joint system that has greater resistance to failures in cold temperatures.

It is a further object of the present invention to provide an expansion joint system that is readily adaptable for use with joints of various widths.

It is a further object of the present invention to provide an expansion joint system that prevents the infiltration of water and contaminants into the joint despite failure due to tearing of the expansible member of the joint system.

It is a further object of the present invention to provide an expansion joint system that is economical to manufacture and install.

Further objects of the present invention will be made apparent in the following Best Modes for Carrying Out Invention and the appended claims.

The foregoing objects are accomplished in the preferred embodiment of the invention by an expansion joint system that traverses a slot between adjacent concrete slabs. The slabs have a boxed out area extending across both slabs. The boxed out area has a first horizontal supporting surface adjacent the slot on the first slab. The second slab has a similar horizontally extending surface adjacent the slot.

A novel aspect of the invention is an expansible member of unitary construction. In the preferred form of the invention the expansible member is made of neoprene material. The expansible member has a body comprising in cross section, a first flap supported on the first supporting surface of the first slab, and a second flap positioned opposite the first flap and supported on the second extending surface of the second slab.

The expansible member further includes a first segment. The first segment in cross section has a first upper pad portion attached to the first flap. The first pad portion includes a first flat upper surface that extends vertically above the first flap. The first pad portion also includes a first outward extending projection. The projection extends vertically upward to about the level of the upper surface of the slabs.

The first segment further includes in cross section, a first web portion. The web portion extends downward into the slot from the first pad portion. The web and pad portions enclose a first elongated, teardrop shaped recess with a rounded bottom.

The expansible member further comprises in cross section, a second segment attached to the second flap. The second segment is similar in construction to the first segment, but is a mirror image thereof. The second segment has a second pad portion, second outward projection, a second web portion and a second enclosed recess.

The first and second segments are connected by a third segment. The third segment includes a third upper pad portion and a third web portion that extends into the slot.

The third pad and web portions bound a third recess which is an elongated diamond shape.

The third web portion is attached to the first and second web portions at locations vertically below the pad portions. The third web portion is connected to the first and third web portions in locations generally on an axis that extends horizontally through the central areas of all three recesses.

In the preferred form of the expansion joint system of the present invention, the flap portions are held to the adjacent horizontally extending surfaces of the slab by a bedding layer of adhesive material which is a urethane/epoxy blend. Nosings of similar urethane/epoxy material are positioned in the boxed out areas above the flaps of the expansible member. The nosings fill the boxed out areas on the sides of the outward projections of the expansible member, and the tops of the nosings are generally even with the top surfaces of the slabs.

BEST MODES FOR CARRYING OUT INVENTION

Figure 1:
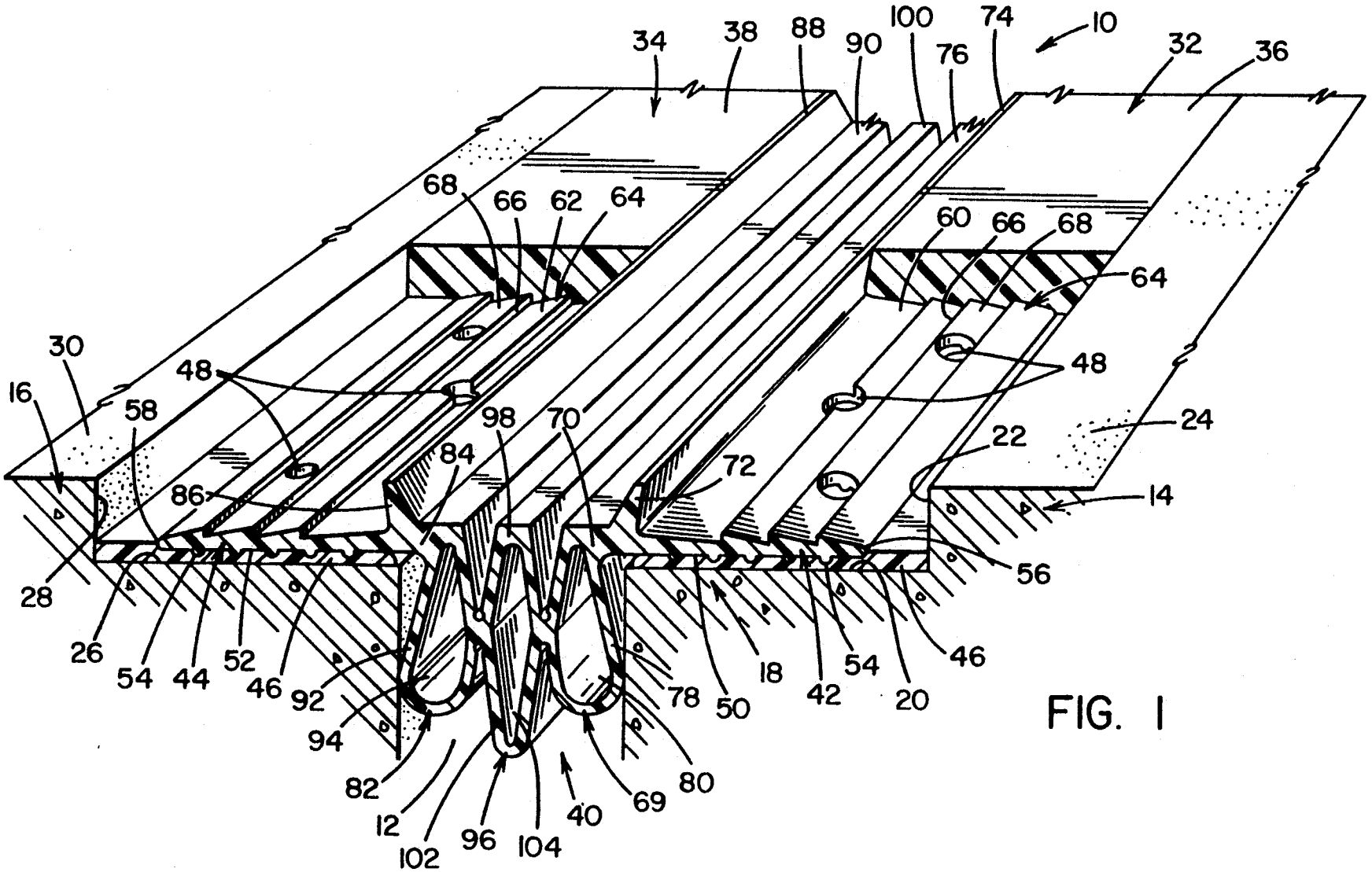
FIG. 1 is an isometric, partially sectioned view of a first embodiment of the expansion joint system of the present invention.

Referring now to the drawings and particularly to FIG. 1, there is shown therein the preferred embodiment of the expansion joint system of the present invention, generally indicated 10. The system traverses a vertical slot 12 between a first concrete slab 14 and a second concrete slab 16. The slabs are part of a structure such as a parking garage, bridge, or plaza deck in which the slabs undergo relative movement due to loading or thermal effects.

Adjacent to slot 12 is a boxed out area 18. The boxed out area is bounded by a first horizontally extending surface 20 and a first vertically extending surface of the first slab 14. Surface 20 is recessed vertically below a top surface 24 of slab 14.

Boxed out area 18 is also bounded by a second horizontally extending surface 26 and a second vertical surface 28 of slab 16, which in cross section are a mirror images of surfaces 20 and 22 of the first slab. Second surface 26 is vertically recessed below a top surface 30 of slab 16. Top surface 30 is generally at the same vertical height as top surface 24 of the first slab.

System 10 includes a first nosing 32 and a second nosing 34. Nosings 32 and 34 have top surfaces 36 and 38 respectively. The top surfaces of the nosings are generally at the same vertical level as the top surfaces 24 and 30 of the slabs. In the preferred form of the invention, the nosings are formed from a material which is a blend of urethane and epoxy. Specifically, the nosings of the preferred form of the invention are a mixture of HPL Urethane Sealant and Tremco Epoxy, both of which are available from the Tremco Company. The urethane and epoxy are mixed in the ratio of 3.00 gallons to 0.75 gallons. This blend of material produces a tough, durable nosing having a hardness of 80 Shore A. A colorant material may be added to the mixture used to form the nosings so that the nosings match the color of the adjacent slabs.

Underlying and bounding nosings 32 and 34 in the expansion joint system, is an expansible member 40. Expansible member 40 has a unitary body of resilient material. In the preferred form of the invention the body of the expansible member is a neoprene rubber having a hardness of about 68 Shore A.

The expansible member has a first flap 42 which underlies nosing 32. The expansible member 40 also has a second flap 44 which underlines nosing 34. Flaps 42 and 44 are held to surfaces 20 and 26 respectively, by a layer 46 of adhesive bedding material. In the preferred form of the invention layer 46 is the same material that is used to form nosings 32 and 34.

Flaps 42 and 44 include two rows of offset holes 48. Holes 48 extend through the flaps and enable the bedding layer 46 to bond directly to the overlying nosings. This improves adhesion and helps to prevent separation of the nosings from the expansible member and the slabs.

Figure 2:
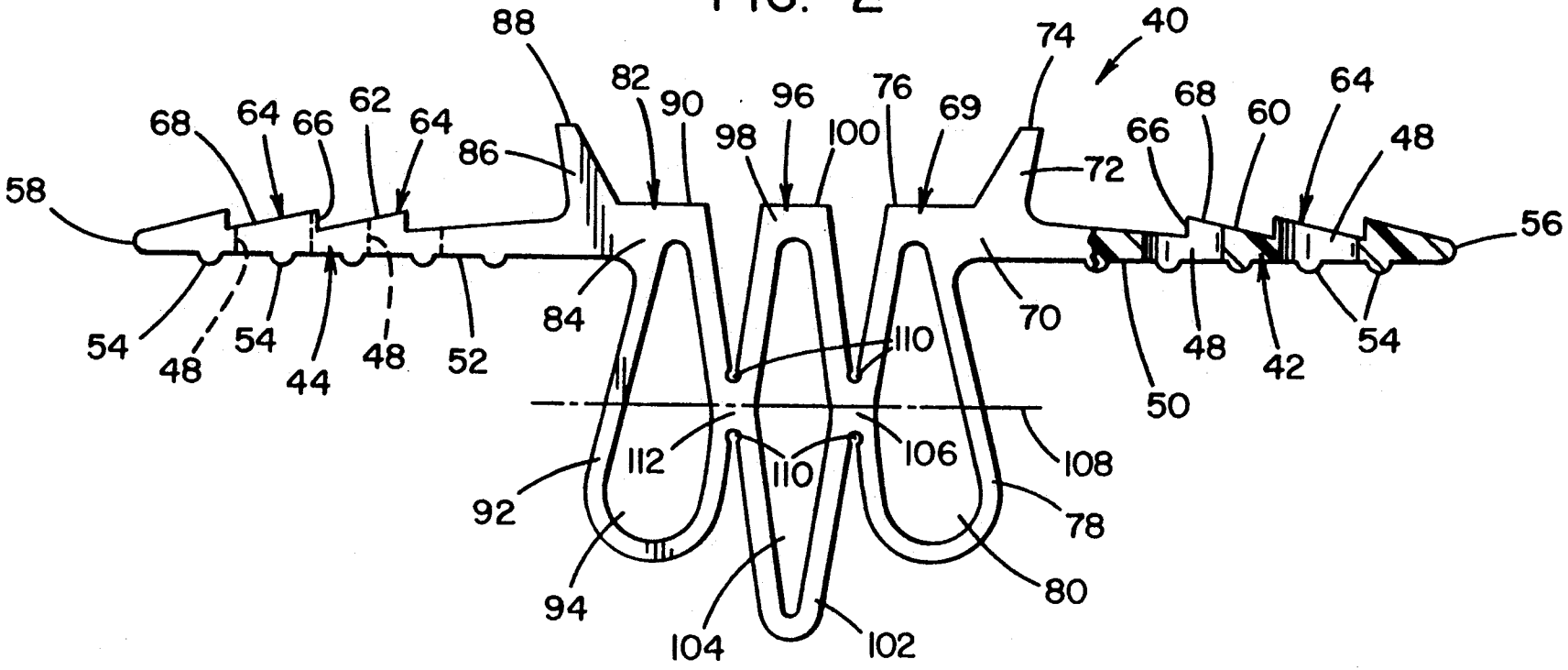
FIG. 2 is a cross sectional view of the expansible member of the expansion joint system.

A cross sectional view of expansible member 40 is shown in FIG. 2. The flaps 42 and 44 have lower surfaces 50 and 52 respectively. The lower surfaces include protuberances 54 extending downward therefrom. In the preferred form of the invention protuberances 54 are continuous linear projections that extend along the underside of the expansible member.

Flaps 42 and 44 have rounded end portions 56 and 58 respectively. As shown in FIG. 1, the rounded end portions are disposed from the vertical surfaces 22 and 28 when the expansible member is installed in the boxed out area between the slabs. This ensures that the flaps lie flat and enables protuberances 54 to lie even with each other in the bedding layer 46 to achieve a good bond.

Flaps 42 and 44 have upper surfaces 60 and 62 respectively. Surfaces 60 and 62 each include three tapered ribs 64. Ribs 64 are each bounded by a vertically extending surface 66 and a tapered surface 68. The tapered surfaces are tapered downward in a direction toward the end of the respective flaps. This configuration helps the nosings hold the flaps when the joint system elongates and the expansible member is stretched. As shown in FIG. 1, holes 48 extend through the flaps in the area of the ribs 64 and the protuberances 54, which aids in holding the expansible member.

Member 40 includes a first segment 69. First segment 69 includes a first pad portion 70 which is attached to first flap 42. First pad portion 70 includes a first outward projection 72. Outward projection 72 has a top edge 74 which has a vertical height generally at the same level as the top surface 36 of the first nosing.

First pad portion 70 has a greater thickness in cross section than the flaps. Pad portion 70 extends from flap 42 and above slot 12. First pad portion 70 has an upper wall 76. Extending downward from first pad portion 70 of segment 69, is a first web portion 78. First web portion 78 is thinner than pad portion 70 and is relatively flexible. First web portion 78, along with the lower area of pad portion 70, encloses a first recess 80. Recess 80 has a generally elongated teardrop shape in cross section and has a rounded bottom.

Expansible member 40 also includes a second segment 82. Second segment 82 is attached to second flap 44 and is a mirror image of first segment 69. Segment 82 has a second pad portion 84 with a second outward extending projection 86. Projection 86 has a top edge 88 which is generally at a vertical height similar to the top surface 38 of nosing 34.

Second pad portion 84 also has a upper wall 90 vertically above the upper surface 62 of the flaps. Second pad portion 84, like first pad portion 70, is relatively thicker than the flaps.

Extending downward from second pad portion 84 is a second web portion 92. Second web portion 92 and pad portion 84, bound a second elongated teardrop shaped recess 94.

Expansible member 40 further includes a third segment 96. Third segment 96 in cross section has a third pad portion 98 which is similar in thickness to the pad portions of the other segments. Third pad portion 98 also has a third upper wall 100, which is generally at the same vertical height as walls 76 and 90 of the other segments.

Third segment 96 has a third web portion 102 which extends downward from pad portion 98 into slot 12. Web portion 102 and pad portion 98, enclose a third recess 104 which in the preferred form of the invention has an elongated diamond shape.

Third web portion 102 is attached to first web portion 78 at a location 106. Location 106 is vertically below the pad portions of the segments. Location 106, where the first and third web portions are attached, extends for a vertical distance along the webs and is generally centered about an axis 108 which extends horizontally and through the central areas of recesses 80, 104 and 94.

Location 106, where web portions 78 and 102 are attached, is bounded on either side by openings 110. Openings 110 are generally circular in cross section and serve to relieve stress at each end of the location where the webs are joined. Openings 110 decrease the possibility that the web portions will separate due to cracking of the expansible member.

Second web portion 92 and third web portion 102 are attached at a second location 112. Location 112 is generally centered along axis 108 and has openings 110 at each end.

In the preferred form of the expansible member shown in FIGS. 1 and 2, the web portions are generally about 0.10 inches in thickness and the pad portions above the recesses to the upper walls are approximately 0.20 inches. The flaps are generally 0.125 inches in thickness with the tapered ribs 64 extend up 0.125 inches from the flaps. The protuberances 54 in the preferred embodiment, extend downward from the lower surface of the flaps 0.062 inches.

The boxed out areas of the slabs are approximately 0.75 to 1.00 inches.

The expansible member shown in FIGS. 1 and 2 is ideally designed to be used with a slot that is approximately two inches across. However, the expansion joint system of the present invention is capable of working satisfactorily if the slot expands to four inches or more, or if the slot contracts to one inch or less, due to relative movement of the slabs.

A further novel aspect of the expansion joint system of the present invention is that it resists the infiltration of water or contaminants into the slot, even in the event of failure. If an exposed pad or web portion of the expansible member is perforated, the web portions provide a secondary seal that prevents material from entering the area between the slabs. As a result, the joint system will continue to prevent contamination which may harm the slabs and the joint system.

The joint system of the present invention also provides a relatively elastic member between relatively tough nosings. The expansible member remains relatively elastic and supple even in colder temperatures. This results in the expansion joint system of the present invention being more resistant to impacts, particularly in cold temperatures.

The installation of the expansion joint system is now described. Installation begins by preparing through grinding and sandblasting, the surfaces bounding the boxed out area 18 of the slabs 14 and 16. The boxed out area is then cleaned and coated with a primer material which in the preferred embodiment is Deckline Primer, which is available from the Tremco Company. The primer is allowed to dry.

The expansible member is cleaned to remove impurities using a solvent such as xylol. The expansible member is then coated with the primer and allowed to dry. A bedding layer 46 of the mixed urethane/epoxy material previously described, is applied on surfaces 20 and 26. Preferably the bedding layer 46 is about 0.125 inches thick. The expansible member is installed with the web portions 78, 92 and 102 extending into slot 12. Flaps 42 and 44 are pressed downward into the bedding layer 46.

Nosings 32 and 34 are then formed of the urethane/epoxy mixture. The nosings are filled to the level of top edges 74 and 78 of the expansible member, which are generally at the same vertical elevation as the top surfaces 24 and 30 of the slabs. After the nosings are troweled to a uniform height, the expansion joint system is allowed to cure for about 24 to 48 hours. Once cured, the expansion joint system provides superior performance under high deflections and impacts, and under severe service conditions.

Figure 3:
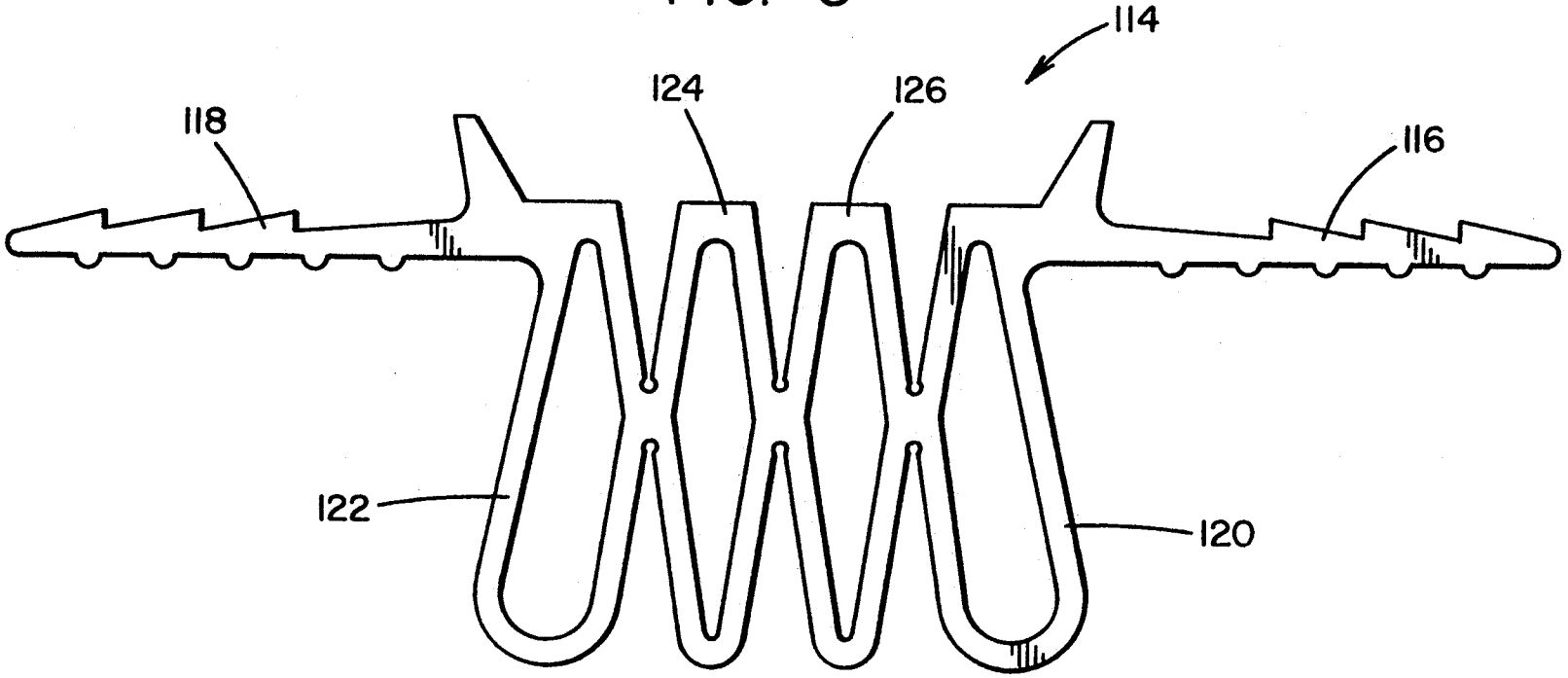
FIG. 3 is a cross sectional view of an alternative expansible member for use in the expansion joint system.

An alternative form of the expansion joint system of the present invention employs an expansible member generally indicated 114 and shown in FIG. 3. Expansible member 114 includes first and second flaps 116 and 118 similar to the flaps of member 40. Member 114 also has first and second segments 120 and 122, similar to segments 169 and 82 of member 40.

Member 114 further includes a third segment 124 and a fourth segment 126 which are positioned between the first and second segments. Segments 124 and 126 are similar in cross section to third segment 96 of expansible member 40. Segments 124 and 126 are attached to the adjacent segments at locations vertically below the pad portions of the segments, and in the vertically central areas of the recesses bounded by the web portions of the segments.

The additional segments in member 114 enables an expansion joint system which includes said member to traverse a wider slot than member 40, and enables the system to accommodate even greater relative movement of the adjacent slabs.

Figure 4:
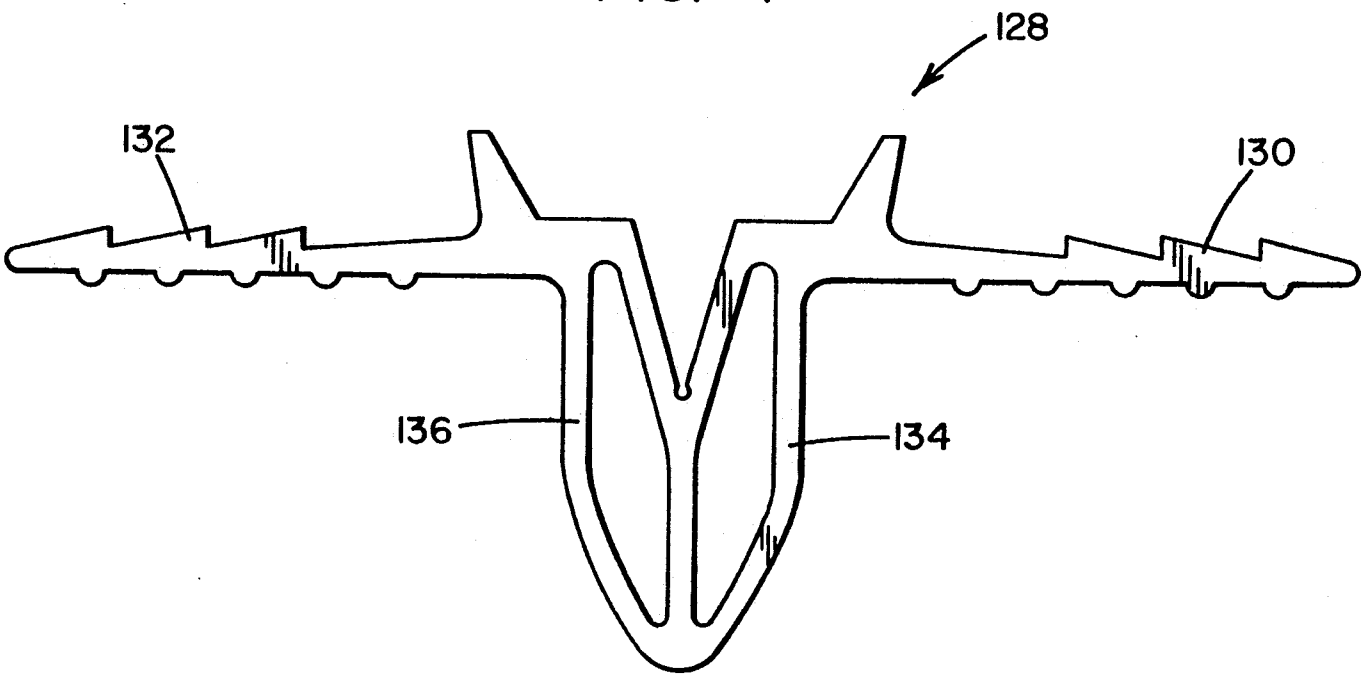
FIG. 4 is a cross sectional view of a further alternative expansion member for use in the expansion joint system.

A further alternative expansible member, generally indicated 128, is shown in FIG. 4. Member 128 is designed to be used in a further alternative embodiment of the expansion joint system of the present invention. Member 128, like the expansible members previously described, has first and second flaps 130 and 132. Member 128 also includes first and second segments 134 and 136 respectively. However, unlike the other members, the webs of the first and second segments of member 128 are attached directly to one another without an intervening segment.

Member 128 is intended for use in systems traversing smaller slots than the members previously described. However, member 128 when used in the expansion joint system of the present invention, provides the superior performance characteristics previously discussed, While only three embodiments of the expansible member have been described, those skilled in the art may apply the principles of the present invention to other embodiments which may be used to traverse wider or thinner slots between adjacent slabs as may be required by the particular application.

Thus, the new expansion joint system of the present invention achieves the above stated objectives, eliminates difficulties encountered in the use of prior devices and systems, solves problems and attains the desirable results described herein.

In the foregoing description, certain terms have been used for brevity, clarity and understanding, however no unnecessary limitations are to be implied therefrom because such terms are for descriptive purposes and are intended to be broadly construed. Moreover, the descriptions and illustrations are by way of examples and the invention is not limited to the details shown and described.

Having described the features, discoveries and principles of the invention, the manner in which it is constructed and operated and the advantages and useful results obtained; the new and useful structures, devices, elements, arrangements, parts, combinations, systems, equipment, operations and relationships are set forth in the appended claims.

I claim:

1. An expansion joint system for coupling first and second slabs of rigid material, said slabs having a slot thereinbetween and a boxed out area adjacent said slot, said first slab in said boxed out area including a first generally horizontally extending surface, and said second slab in said boxed out area including a second generally horizontally extending surface, said joint system comprising:

an expansible member having a body comprising in cross section;

a first resilient flap supported on said first horizontally extending surface;

a second resilient flap supported on said second horizontally extending surface;

a first resilient segment, said first resilient segment including:

a first upper pad portion attached to said first flap and extending above said slot, said first pad portion having a first upper wall extending vertically above said first flap;

a first web portion, said web portion extending vertically downward from said first pad portion into said slot, said first web portion and said first pad portion enclosing a first recess;

a second resilient segment, said second segment including:

a second upper pad portion attached to said second flap and extending above said slot, said second pad portion having a second upper wall extending vertically above said second flap and to generally the level of said first upper wall; and a second web portion extending vertically downward from said second pad portion into said slot, said second web portion and said second pad portion enclosing a second recess;

connecting means for connecting said first and second web portions at a location vertically below said pad portions, said first and second web portions being adjacent but separate above said location;

said joint system further including:

first attaching means for attaching said first flap to said first horizontally extending surface, and second attaching means for attaching said second flap to said second horizontally extending surface;

nosings above said first and second flaps in said boxed out area, said nosings including upper nosing surfaces extending vertically to at least the level of said first and second upper walls of said expansible member.

2. The expansion joint system according to claim 1 wherein said connecting means of said expansible member comprises:

a third segment, said third segment including:

a third upper pad portion having a third upper wall extending vertically generally to the level of said first and second upper walls; and a third web portion extending vertically downward from said third pad portion, said third pad portion and third web portion enclosing a third recess;

said third web portion attached to said first web portion at a first side of said third web portion, and said third web portion attached to said second web portion at an opposed second side of said third web portion at said location.

3. The expansion joint system according to claim 2 wherein said first pad portion of said member includes a first vertically outward extending projection having a first top edge extending vertically upward beyond said first upper wall; and wherein said second pad portion includes a second vertically outward extending projection having a second top edge generally at the level of said first top edge; and wherein said nosings extend vertically generally to the level of said top edges.

4. The expansion joint system according to claim 3 wherein said first, second and third recesses are vertically elongated, and said web portions are attached to said adjacent web portions generally coaxially along a horizontal axis extending through vertically central areas of said recesses.

5. The expansion joint system according to claim 4 wherein said pad portions of said expansible member have a thickness in a vertical direction greater than a wall thickness of said associated web portions, whereby said pad portions are rigid relative to said web portions.

6. The expansion joint system according to claim 5 wherein said first and second flaps of said expansible member have holes extending vertically therethrough, whereby said nosing material extends through said holes.

7. The expansion joint system according to claim 6 wherein said flaps of said expansible member include in cross section, downward extending protuberances, and wherein said attaching means for said flaps is a layer of an adhesive bedding material, said nosings attached to said layer through said holes in the flaps.

8. The expansion joint system according to claim 7 wherein said flaps of said expansible member include in cross section, tapered ribs disposed of said outward projections, said ribs having vertically outward extending surfaces and tapered surfaces extending downwardly in a direction away from said slot.

9. The expansion joint system according to claim 8 wherein said holes through said flaps are arranged in two rows in each flap, said holes in each row positioned alternatively and horizontally disposed from holes in an adjacent row.

10. The expansion joint system according to claim 9 wherein said nosings are formed of a resilient material that is relatively harder than the material comprising said expansible member.

11. The expansion joint system according to claim 10 wherein in the undeformed condition of said expansible member, in cross section said first recess has an elongated generally teardrop shape, said recess being generally rounded in a lowermost portion.

12. The expansion joint system according to claim 11 and wherein in the undeformed condition of the expansible member in cross section, said second recess has a generally elongated teardrop shape, said recess being generally rounded in a lowermost portion.

13. The expansion joint system according to claim 12 wherein in the undeformed condition of said expansible member in cross section, said third recess is an elongated diamond shape.

14. The expansion joint system according to claim 13 wherein said third web portion is integral with said first and second web portions, and said third web portion in cross section is attached to said first web portion at a first location, and said first location is bounded by generally circular openings at vertically uppermost and lowermost ends, and further wherein said third web portion is attached to said second web portion at a second location and said second location is bounded at vertically uppermost and lowermost ends by generally circular openings, whereby said openings enable greater stretching of said expansible member without tearing at said first and second locations.

15. The expansion joint system according to claim 14 wherein said expansible member includes in cross section, at least one further segment similar in cross section to said third segment, and wherein said further segment is positioned adjacent said third segment and disposed between first and second segments, said further segment being attached to adjacent segments at a further location below said pad portions of said segments.

16. The expansion joint system according to claim 15 wherein in cross section, the upper walls of said segments extend generally horizontally and at generally the same vertical level.

17. The expansion joint system according to claim 16 wherein said expansible member is comprised of neoprene rubber and is of unitary construction.

* * * * *